US008414766B2

(12) United States Patent
Mordukhovich et al.

(10) Patent No.: US 8,414,766 B2
(45) Date of Patent: Apr. 9, 2013

(54) SERVICEABLE OIL FILTER DEVICE

(75) Inventors: Gregory Mordukhovich, Bloomfield Hills, MI (US); James L. Linden, Rochester Hills, MI (US); Andrew M. Mance, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 500 days.

(21) Appl. No.: 12/578,794

(22) Filed: Oct. 14, 2009

(65) Prior Publication Data

US 2011/0084010 A1 Apr. 14, 2011

(51) Int. Cl.
*F01M 11/03* (2006.01)
*B01D 61/00* (2006.01)

(52) U.S. Cl. ..... 210/167.04; 210/644; 210/641; 210/651; 210/690; 210/777; 210/321.64; 210/321.77; 210/321.78; 210/321.86; 210/321.87; 210/338; 210/342; 210/345; 210/443; 210/493.5

(58) Field of Classification Search ..... None
See application file for complete search history.

(56) References Cited

U.S. PATENT DOCUMENTS 6,478,958 B1 * 11/2002 Beard et al. ..... 210/323.2
2005/0194309 A1 * 9/2005 Harenbrock et al. ..... 210/500.1
2008/0110819 A1 * 5/2008 Rohrbach et al. ..... 210/337

* cited by examiner

*Primary Examiner* — Krishnan S Menon
*Assistant Examiner* — Allison M Gionta

(57) ABSTRACT

A serviceable device for filtering lubricating oil includes an inlet and an outlet, a first filtering element and an absorption filtering element. The absorption filtering element is configured to absorb a fluidic contaminant present in the lubricating oil when in contact with the absorption filtering element. A flow path for the lubricating oil is from the inlet, through the first filtering element, and out the outlet. The flow path further includes lubricating oil contact with the absorption filtering element.

16 Claims, 3 Drawing Sheets

SERVICEABLE OIL FILTER DEVICE

TECHNICAL FIELD

This disclosure is related to lubricating oil filter devices, including serviceable oil filter devices associated with vehicles.

BACKGROUND

The statements in this section merely provide background information related to the present disclosure and may not constitute prior art.

Engine systems and other vehicle systems such as transmissions and driveline gear devices use oil filter devices that remove solid and liquid contaminants from lubricating oil. This includes engine oil filters that filter lubricating oil prior to circulation to engine components including crankshaft bearings, camshaft bearings, lifters, and pistons. Engine systems include oil pumps that pump pressurized oil through the oil filter device.

Known oil filter devices remove solid contaminants from lubricating oil prior to circulating the lubricating oil to engine components including crankshaft bearings, camshaft bearings, lifters, and pistons. Vehicle systems include oil pumps that pump pressurized oil through the oil filter device. Known oil filter devices include pre-filtering elements including mesh stainless steel screens to remove large solid contaminants. Known oil filters include filtering elements including cotton fibrous filter elements to remove smaller solid contaminants. Known oil filter devices include magnetized elements for removing ferrous particles contained in the oil.

Combustion in internal combustion engine systems generates combustion gases, a portion of which can be forced past engine pistons to an engine crankcase, in a process referred to as blow-by. Combustion gases that blow-by pistons end up in the engine crankcase. A portion of the combustion gases in the engine crankcase can be recirculated into the engine intake system via a crankcase ventilation process, whereby they are burned during combustion. A portion of the combustion gases in the engine crankcase can precipitate and be absorbed into the lubricating oil, thus affecting lubricity of the lubricating oil and reducing service life of the lubricating oil. The condensed combustion gases contained in crankcase oil can include fluidic contaminants in the form of unburned fuel and combustion components, e.g., hydrocarbons, alcohols (ethanol and methanol), and water. Presence and amount of fluidic contaminants can affect the lubricity and service life of lubricating oil.

SUMMARY

A serviceable device for filtering lubricating oil includes an inlet and an outlet, a first filtering element and an absorption filtering element. The absorption filtering element is configured to absorb a fluidic contaminant present in the lubricating oil when in contact with the absorption filtering element. A flow path for the lubricating oil is from the inlet, through the first filtering element, and out the outlet. The flow path further includes lubricating oil contact with the absorption filtering element.

BRIEF DESCRIPTION OF THE DRAWINGS

One or more embodiments will now be described, by way of example, with reference to the accompanying drawings, in which.

DETAILED DESCRIPTION

Figure 1:
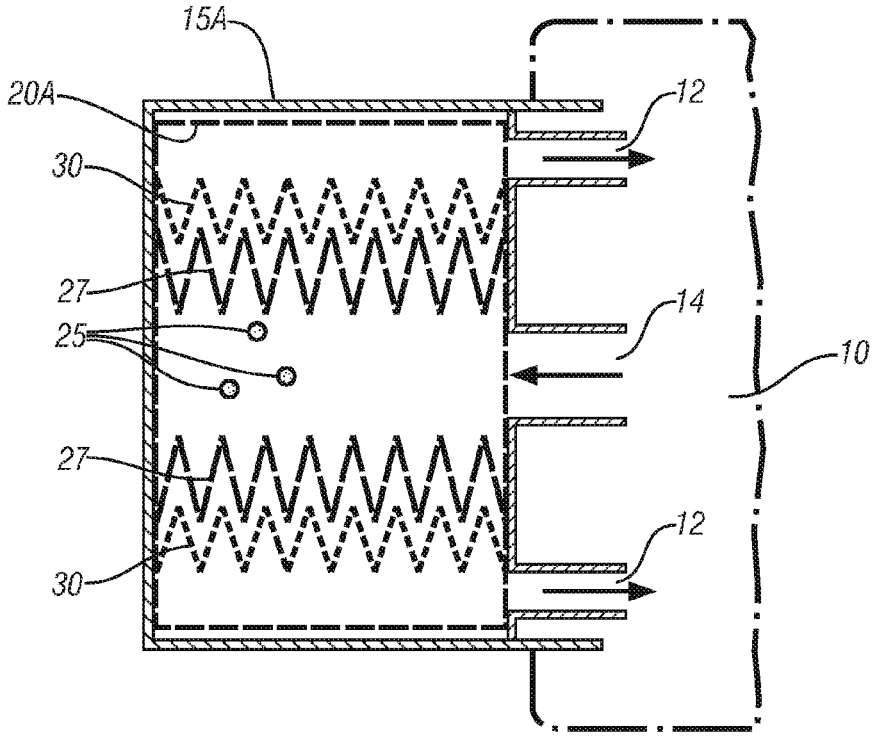
FIGS. 1-5 are two-dimensional schematic diagrams in accordance with the present disclosure.

Referring now to the drawings, wherein the showings are for the purpose of illustrating certain exemplary embodiments only and not for the purpose of limiting the same, FIGS. 1-5 schematically illustrate embodiments of a serviceable oil filtering device 15 including a filtering element 20. Like numerals refer to like elements in the various embodiments. The embodiments depict a unitary serviceable device including the oil filtering device 15 as a formed-metal thin wall canister device containing the filtering element 20. A person skilled in the art understands that the concepts described herein can be embodied in other packaging configurations with similar effect. One alternative packaging configuration includes the filtering element 20 as a replaceable canister element that can be inserted into a permanent oil filtering device. In one embodiment, the oil filtering device 15 containing the filtering element 20 is attached to an internal combustion engine 10 to effect filtering of engine oil. Alternatively, the oil filtering device 15 containing the filtering element 20 is attached to a transmission device to effect filtering of transmission fluid. Alternatively, the oil filtering device 15 containing the filtering element 20 is attached to a driveline differential to effect filtering of gear oil. The oil filtering device 15 containing the filtering element 20 described herein is preferably a replaceable component having a preferred service life that is in the range of 4,800 km to 16,000 km (3000-10,000 miles), depending upon the in-use service conditions and the type of oil used, e.g., hydrocarbon-based oils and synthetic oils. The oil filtering device 15 includes an inlet tube 14 and at least one outlet tube 12. In one embodiment, an oil pump device pumps pressurized oil from a sump to the inlet tube 14. Oil pressure can be in a range of 200 kPa to 800 kPa (30 psi to 120 psi) in one embodiment. The oil passes through the filtering element 20 to one or more outlet tubes 12 and is channeled to engine components in need of oil.

The filtering element 20 includes a first filtering element 27 and an absorption filtering element 30. The first filtering element 27 is configured to primarily filter solid contaminants contained in the oil, including e.g., metallic and carbon particles. The absorption filtering element 30 is configured to primarily absorb a fluidic contaminant 25 present in the lubricating oil.

The first filtering element 27 is an annular element constructed from fibrous paper that fixedly seals within the oil filtering device 15 such that lubricating oil pumped into the inlet tube 14 passes through the first filtering element 27 to reach the outlet tube 12.

The absorption filtering element 30 is configured to remove one or more fluidic contaminants 25 from the lubricating oil, preferably during filtering of the lubricating oil through the filtering element 20. The absorption filtering element 30 preferably includes absorption media including cellulose fiber, silica gel and/or aluminum oxide disbursed on a substrate and installed into the filtering element 20 as described with reference to the various embodiments. Exemplary silica gel has a particle size range between 75 and 250 microns (Mesh 200-60). One example volume of the silica gel is 4 g. Exemplary aluminum oxide has a particle size range between 75 and 250 microns (Mesh 200-60). An example volume of the aluminum oxide is 4 g. In one embodiment, the filtering element can include a cellulose fiber substrate having one of aluminum oxide and silica gel disbursed thereon.

Fluidic contaminants 25 contained in the lubricating oil of an internal combustion engine originate from in-cylinder combustion and cylinder blow-by. The fluidic contaminant 25 may be in a gaseous or aerosol form when entering an engine crankcase. For purposes of the disclosure, a fluidic contaminant 25 is a non-oil element that precipitates to a liquid form at ambient temperatures, e.g., between 50° C. and 0° C. One or more fluidic contaminants 25 may be found in the crankcase. Fluidic contaminants 25 include fuel and combustion components, including, e.g., hydrocarbon fuels, alcohols (ethanol and methanol), and water. Fluidic contaminants 25 can pass engine piston rings during combustion. When not operating, the engine 10 loses heat and cools to ambient temperatures. Oil drains out of oil galleys to the crankcase. The airborne fluidic contaminants 25 that are present in a head space of a crankcase precipitate out and mix with engine oil in the crankcase. The absorption filtering element 30 preferably absorbs a specific one of the fluidic contaminants contained in the lubricating oil.

Each of the embodiments includes a flow path for pressurized oil originating from the oil pump of the engine 10, and is described in terms of contact with the first filtering element 27 and contact with the absorption filtering element 30.

FIG. 1 shows a first embodiment of the oil filtering device 15A including the filtering element 20A. The filtering element 20A includes the annular first filtering element 27 and the absorption filtering element 30. The absorption filtering element 30 is an annular element that encompasses the first filtering element 27 and is located between the outlet tube 12 and the first filtering element 27 when assembled into the oil filtering device 15A. In this embodiment, all the pressurized oil passes from the inlet tube 14 through the first filtering element 27 and then through the absorption filtering element 30 prior to flowing to the outlet tube 12. In such embodiment, the oil flow is said to be through the through the absorption filtering element 30 which provides flow through filtering. The absorption filtering element 30 is preferably configured to absorb a single one of the fluidic contaminants 25, e.g., one of water, fuel, and alcohol.

Figure 2:
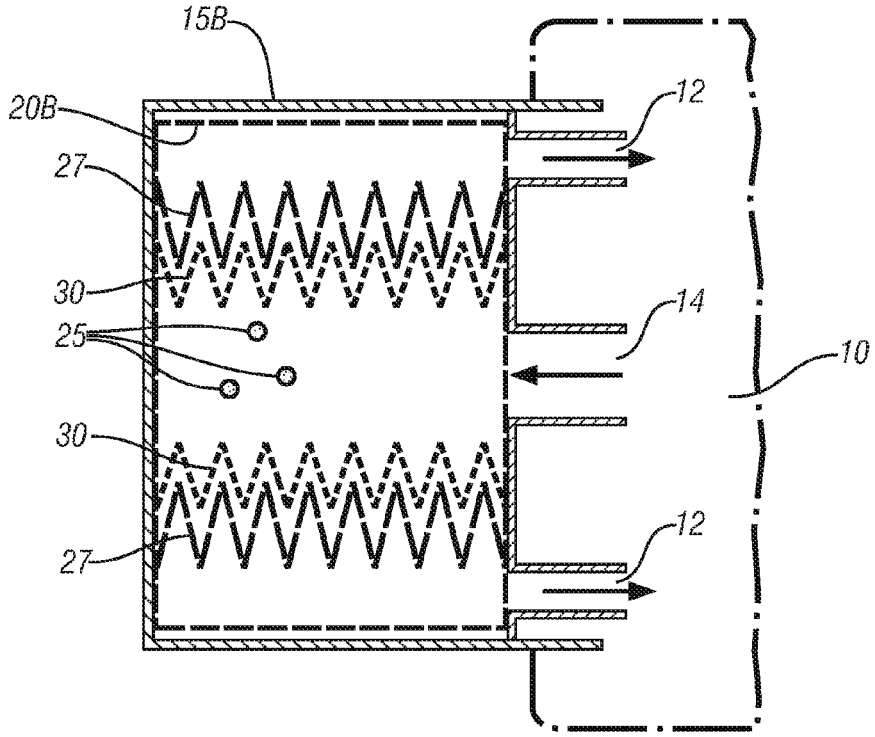

FIG. 2 shows a second embodiment of the oil filtering device 15B including the filtering element 20B. The filtering element 20B includes the annular first filtering element 27 and the absorption filtering element 30. The absorption filtering element 30 is an annular element that is contained within the first filtering element 27 and is located on the inlet tube 14 side of the first filtering element 27 when assembled into the oil filtering device 15B. In this embodiment, all pressurized oil passes from the inlet tube 14 through the absorption filtering element 30 and then through the first filtering element 27 prior to flowing to the outlet tube 12. In such embodiment, the oil flow is said to be through the through the absorption filtering element 30 which provides flow through filtering. The absorption filtering element 30 is preferably configured to absorb a single one of the fluidic contaminants 25, e.g., one of water, fuel, and alcohol.

Figure 3:
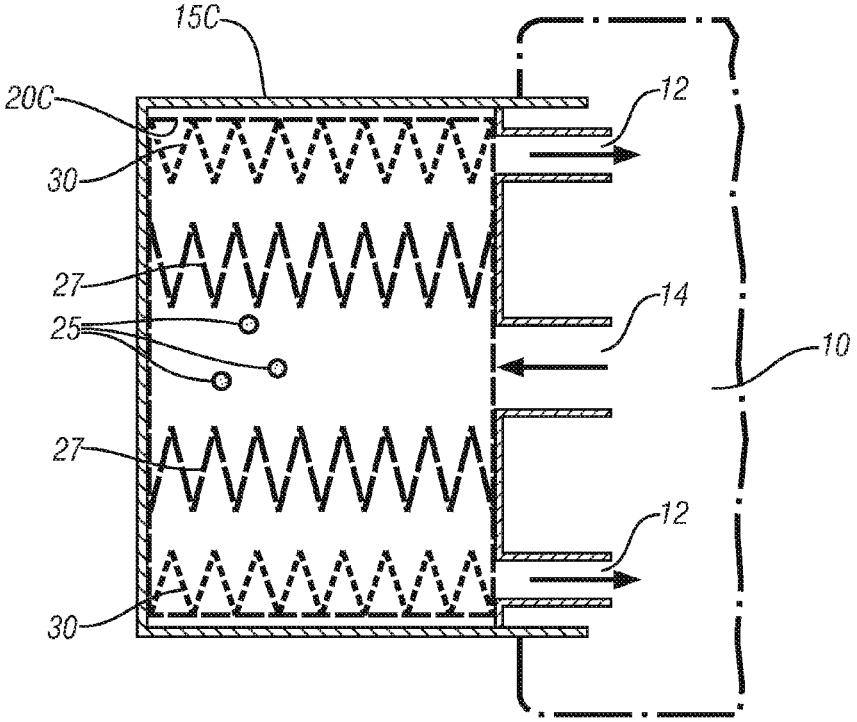

FIG. 3 shows a third embodiment of the oil filtering device 15C including the filtering element 20C. The filtering element 20C includes the annular first filtering element 27 and the absorption filtering element 30. The absorption filtering element 30 includes an annular element that preferably encircles a portion of the first filtering element 27 and is located on the outlet tube 12 side of the first filtering element 27 when assembled into the oil filtering device 15C. In this embodiment, the absorption filtering element 30 is preferably contiguous to an outside wall of the oil filtering device 15C. In this embodiment, all pressurized oil passes from the inlet tube 14 through the first filtering element 27 prior to flowing to the outlet tube 12. Pressurized oil can physically contact the absorption filtering element 30 subsequent to passing through the first filtering element 27, but is not forced to pass through it to reach the outlet tube 12. In such embodiment, the oil flow is said to be across the absorption filtering element 30 which provides contact filtering. The absorption filtering element 30 is preferably configured to absorb a single one of the fluidic contaminants 25, e.g., one of water, fuel, and alcohol.

Figure 4:
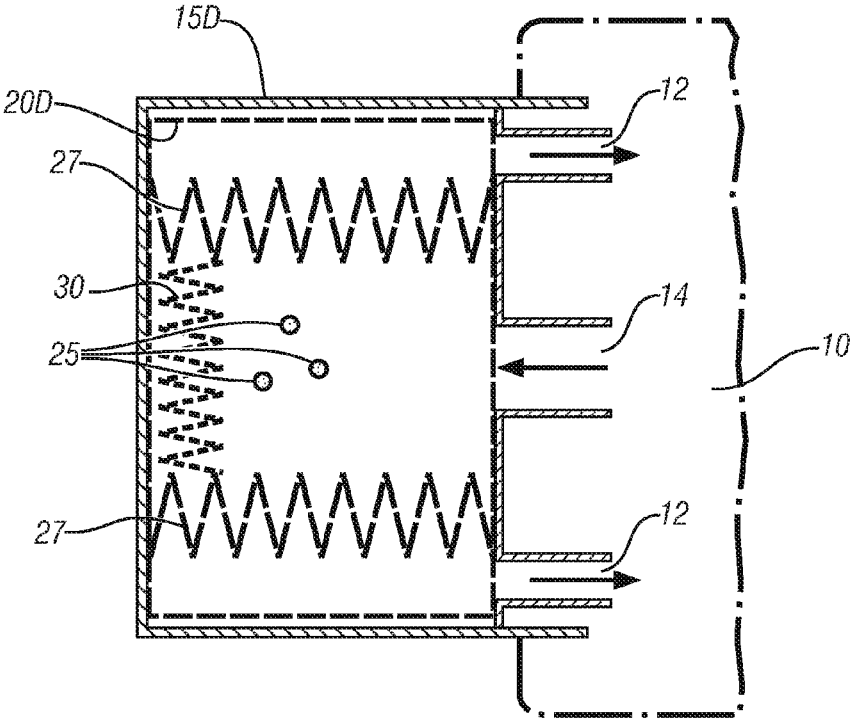

FIG. 4 shows a fourth embodiment of the oil filtering device 15D including the filtering element 20D. The filtering element 20D includes the annular first filtering element 27 and the absorption filtering element 30. The absorption filtering element 30 includes an element that is located on the inlet tube 14 side of the first filtering element 27 when assembled into the oil filtering device 15D. In this embodiment, the absorption filtering element 30 is preferably contiguous to an outside wall of the oil filtering device 15D. In this embodiment, all pressurized oil passes from the inlet tube 14 through the first filtering element 27 prior to flowing to the outlet tube 12. Pressurized oil can physically contact the absorption filtering element 30 prior to passing through the first filtering element 27, but is not forced to pass through the absorption filtering element 30 to reach the outlet tube 12. In such embodiment, the oil flow is said to be across the absorption filtering element 30 which provides contact filtering. The absorption filtering element 30 is preferably configured to absorb a single one of the fluidic contaminants 25, e.g., one of water, fuel, and alcohol.

Figure 5:
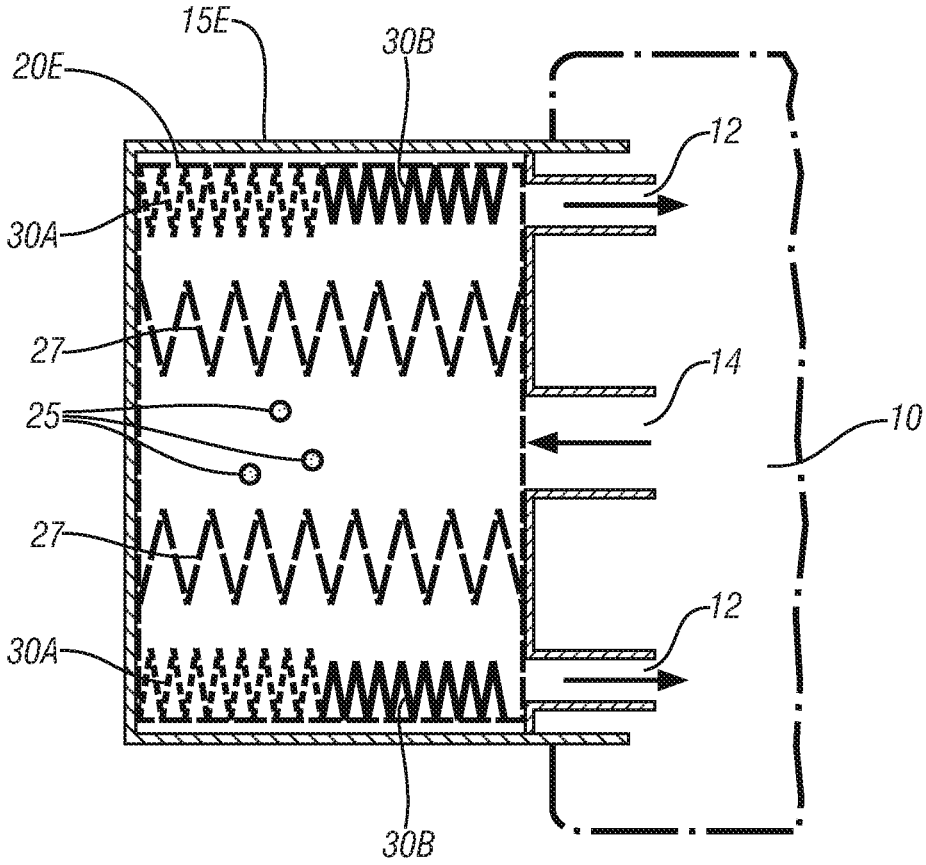

FIG. 5 shows a fifth embodiment of the oil filtering device 15E including the filtering element 20E. The filtering element 20E includes the annular first filtering element 27 and first and second absorption filtering elements 30A and 30B. The first and second absorption filtering elements 30A and 30B include first and second annular elements that preferably encircle portions of the first filtering element 27 and are located on the outlet tube 12 side of the first filtering element 27 when assembled into the oil filtering device 15E. In this embodiment at least one of the first and second absorption filtering elements 30A and 30B is preferably contiguous to an outside wall of the oil filtering device 15E. In this embodiment, all pressurized oil passes from the inlet tube 14 through the first filtering element 27 prior to flowing to the outlet tube 12. Pressurized oil can come into physical contact with first and second absorption filtering elements 30A and 30B subsequent to passing through the first filtering element 27, but is not forced to pass through them to reach the outlet tube 12. In such embodiment, the oil flow is said to be across the absorption filtering elements 30A and 30B which provide contact filtering. As shown, each of the first and second absorption filtering elements 30A and 30B is configured to absorb a single one of the fluidic contaminants 25, e.g., one of water, fuel, and alcohol. By way of example, the first absorption filtering element 30A is configured to absorb the fluidic contaminant 25 including water, and the second absorption filtering element 30B is configured to absorb the fluidic contaminant 25 including alcohol.

In an alternative embodiment consistent with first and second absorption filtering elements and envisioned as a combination of the arrangements described herein with respect to FIGS. 1-5 including the various flow through and contact filtering arrangements and inlet tube and outlet tube side placements, the first absorption filtering element can include a first annular element that preferably encircles the first filtering element 27 and is located on the outlet tube 12 side of the first filtering element 27 (e.g. FIGS. 1 and 3) when assembled into the oil filtering device 15E and the second absorption filtering element can include a second element that is located on the inlet tube 14 side of the first filtering element 27 when assembled into the oil filtering device 15E (e.g. FIGS. 2 and 4).

In an alternative embodiment, the oil filtering device 15 including the filtering element 20, which includes the annular first filtering element 27 and first, second, and third absorption filtering elements 30. A first absorption filtering element is configured to absorb the fluidic contaminant 25 including water, a second absorption filtering element is configured to absorb the fluidic contaminant 25 including alcohol, and a third absorption filtering element is configured to absorb the fluidic contaminant 25 including fuel. The first, second and third filtering elements can be positioned variously as described herein above in a combination of the arrangements described herein with respect to FIGS. 1-5 including the various flow through and contact filtering arrangements and inlet tube and outlet tube side placements.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A serviceable device for filtering lubricating oil, comprising:

an inlet and an outlet;

a first filtering element and an absorption filtering element;

the absorption filtering element configured to absorb a fluidic contaminant present in the lubricating oil when in contact with the absorption filtering element; and a flow path for the lubricating oil from the inlet, through the first filtering element, and out the outlet, said flow path further including said lubricating oil having only non-pass-through physical contact with the absorption filtering element.

2. The serviceable device for filtering lubricating oil of claim 1, wherein the absorption filtering element is located in the flow path that is between the inlet and first filter element.

3. The serviceable device for filtering lubricating oil of claim 1, wherein the absorption filtering element is located in the flow path that is between the first filter element and the outlet.

4. The serviceable device for filtering lubricating oil of claim 1, wherein the absorption filtering element is configured to absorb a fluidic contaminant comprising alcohol.

5. The serviceable device for filtering lubricating oil of claim 1, wherein the absorption filtering element is configured to absorb a fluidic contaminant comprising water.

6. The serviceable device for filtering lubricating oil of claim 1, wherein the absorption filtering element is configured to absorb a fluidic contaminant comprising fuel hydrocarbons.

7. The serviceable device for filtering lubricating oil of claim 1, wherein the absorption filtering element comprises silica.

8. The serviceable device for filtering lubricating oil of claim 7, wherein the silica has a particle size between 75 and 250 microns.

9. The serviceable device for filtering lubricating oil of claim 1, wherein the absorption filtering element comprises aluminum oxide.

10. The serviceable device for filtering lubricating oil of claim 9, wherein the aluminum oxide has a particle size range between 75 and 250 microns.

11. The serviceable device for filtering lubricating oil of claim 1, wherein the absorption filtering element comprises cellulose fiber.

12. A serviceable device for filtering lubricating oil, comprising:

an inlet and an outlet;

a first filtering element and an absorption filtering element;

the first filtering element configured to remove solid particles from the lubricating oil when the lubricating oil passes through the first filtering element;

the absorption filtering element configured to absorb a fluidic contaminant present in the lubricating oil when the lubricating oil contacts the absorption filtering element, said absorption filtering element comprising at least one of silica and aluminum oxide disbursed on a substrate; and a flow path for the lubricating oil from the inlet, through the first filtering element, and out the outlet, said flow path further including said lubricating oil having only non-pass-through physical contact with the absorption filtering element.

13. The serviceable device for filtering lubricating oil of claim 12, wherein said at least one of silica and aluminum oxide disbursed on the substrate has a particle size between 75 and 250 microns.

14. The serviceable device for filtering lubricating oil of claim 12, wherein the absorption filtering element substrate comprises a cellulose fiber.

15. A serviceable device for filtering lubricating oil, comprising:

an inlet and an outlet;

a first filtering element and an absorption filtering element;

an absorption filtering element configured to absorb a fluidic contaminant present in the lubricating oil when in contact with the absorption filtering element;

a flow path for the lubricating oil from the inlet, through the first filtering element, and out the outlet, said flow path further including said lubricating oil having only non-pass-through physical contact with the absorption filtering element; and said absorption filtering element being located in one of a) the flow path between the inlet and first filter element and b) the flow path between the outlet and first filter element.

16. The serviceable device for filtering lubricating oil of claim 15, wherein the absorption filtering element comprises a cellulose fiber substrate and at least one of silica and aluminum oxide disbursed on the substrate, said at least one of silica and aluminum oxide having a particle size between 75 and 250 microns.

* * * * *